US006416382B1

(12) United States Patent
Bavelloni

(10) Patent No.: US 6,416,382 B1
(45) Date of Patent: Jul. 9, 2002

(54) BILATERAL AUTOMATIC MACHINE FOR EDGE-MACHINING PLATES OF GLASS, STONE-LIKE MATERIALS AND THE LIKE

(75) Inventor: Franco Bavelloni, San Fermo Della Battaglia (IT)

(73) Assignee: Z. Bavelloni S.p.A., Bregnano (IT)

( * ) Notice: Subject to any disclaimer, the term of this patent is extended or adjusted under 35 U.S.C. 154(b) by 0 days.

(21) Appl. No.: 09/578,733

(22) Filed: May 26, 2000

(30) Foreign Application Priority Data

Jun. 21, 1999 (IT) ..... MI99A1382

(51) Int. Cl.[7] ..... B24B 49/00; B24B 51/00

(52) U.S. Cl. ..... 451/5; 451/8; 451/66; 451/190; 451/194; 451/207

(58) Field of Search ..... 451/5, 6, 8, 9, 451/10, 43, 44, 65, 66, 182, 184, 188, 190, 194, 207

(56) References Cited

U.S. PATENT DOCUMENTS

| | | | | |
|---|---|---|---|---|
| 4,375,141 A | * | 3/1983 | Gaetano | 451/159 |
| 4,375,738 A | * | 3/1983 | Bando | 451/159 |
| 4,437,268 A | * | 3/1984 | Righetti | 451/41 |
| 6,171,178 B1 | * | 1/2001 | Park | 451/159 |

FOREIGN PATENT DOCUMENTS

| | | |
|---|---|---|
| EP | 0 689 899 | 1/1996 |
| GB | 2 261 433 | 5/1993 |

OTHER PUBLICATIONS

Patent Abstracts of Japan vol. 017, No. 385 (M–1448), Ju.. 20, 1993 (1993–07–20)–& JP 05 069318 A (Asahi Glass Co Ltd), Mar. 23, 1993 (1993–03–23) * abstract; figures*.

* cited by examiner

*Primary Examiner*—Timothy V. Eley
(74) *Attorney, Agent, or Firm*—Guido Modiano; Albert Josif; Daniel O'Byrne

(57) ABSTRACT

A bilateral automatic machine for machining the edges of plates of glass, stone-like and of other plate shaped materials and the like, comprising a supporting frame which has a conveyor for the plates to be machined. There are also provided an abutment shoulder and a movable shoulder for supporting abrasive grinding wheels which act on the opposite edges of the plates. The machine comprises, for each shoulder, downstream of the last grinding wheel in the direction of advancement of the plates, a sensor for detecting the dimensions of the plates being machined which drives an advancement device for the advancement of the last grinding wheel. Each grinding wheel except for the first grinding wheel along the advancement direction of the plates is provided with a detector for detecting the energy absorbed by the corresponding motor and an actuator for actuating the advancement device of the grinding wheel that is located immediately upstream as the energy absorbed by the grinding wheel located immediately downstream of it increases.

11 Claims, 1 Drawing Sheet

BILATERAL AUTOMATIC MACHINE FOR EDGE-MACHINING PLATES OF GLASS, STONE-LIKE MATERIALS AND THE LIKE

BACKGROUND OF THE INVENTION

The present invention relates to a bilateral automatic machine for machining the edges of plates of glass, stone-like and of other plate shaped materials and the like.

It is known that bilateral machines for machining the edges of glass are already commercially available and are generally constituted by a supporting frame which forms a conveyor for the plates to be machined.

An abutment shoulder and a movable shoulder for support are provided at the working surface formed by the plate, and the grinding wheels which perform in succession the step of removing the excess part of the edge, up to the final step of finishing by polishing said edge, are provided on such shoulders.

In these machines it is necessary to stop production rather frequently in order to inspect the chatter marks of the diamond grinding wheels, in order to check their correct position and perform the new positioning determined by the gradual wear of said grinding wheel.

Another problem further consists in that it is necessary to continuously check the dimensions of the plates in output and possibly halt production in order to move the movable shoulder so as to compensate for grinding wheel wear.

It is evident that this type of operation requires considerable manual work and furthermore does not allow to perform adjustment simultaneously with the gradual wear of the grinding wheel; this inevitably leads to uneven production and inconstant quality.

SUMMARY OF THE INVENTION

The aim of the present invention is to eliminate the above-noted drawbacks, by providing a bilateral automatic machine for machining the edges of plates of glass, stone-like materials and the like which allows to automatically and continuously adjust the position of the individual grinding wheels so as to always obtain a correct working position.

Within the scope of this aim, a particular object of the present invention is to provide a bilateral automatic machine which allows to obtain production with constant quality in terms of polished finish and in terms of dimensions.

Another object of the present invention is to provide a bilateral automatic machine which, by way of its particular constructive characteristics, is capable of giving the greatest assurances of reliability and safety in use.

Another object of the present invention is to provide a bilateral automatic machine which can be easily obtained starting from commonly commercially available elements and materials and is further competitive from a merely economical point of view.

These and other objects which will become better apparent hereinafter are achieved by a bilateral automatic machine for machining the edges of plates of glass, stone-like and of other plate shaped materials and the like, according to the invention, comprising a supporting frame which has a conveyor for the plates to be machined, an abutment shoulder and a movable shoulder for supporting abrasive grinding wheels being further provided, said grinding wheels acting on the opposite edges of said plates, characterized in that it comprises, for each shoulder, downstream of the last grinding wheel in the direction of advancement of said plates, a sensor for detecting the dimensions of the plates being machined which drives means for the advancement of the last grinding wheel, each grinding wheel except for the first grinding wheel upstream along the advancement direction of the plates being provided with means for detecting the energy absorbed by the corresponding motor and means for actuating the advancement means of the grinding wheel that is located directly upstream as the energy absorbed by the grinding wheel located directly downstream of it increases.

BRIEF DESCRIPTION OF THE DRAWINGS

Further characteristics and advantages of the present invention will become better apparent from the following detailed description of a preferred but not exclusive embodiment of a bilateral automatic machine for machining the edges of plates of glass, stone-like materials and the like, illustrated only by way of non-limitative example in the accompanying drawings, wherein.

DESCRIPTION OF THE PREFERRED EMBODIMENTS

Figures 1, 2:
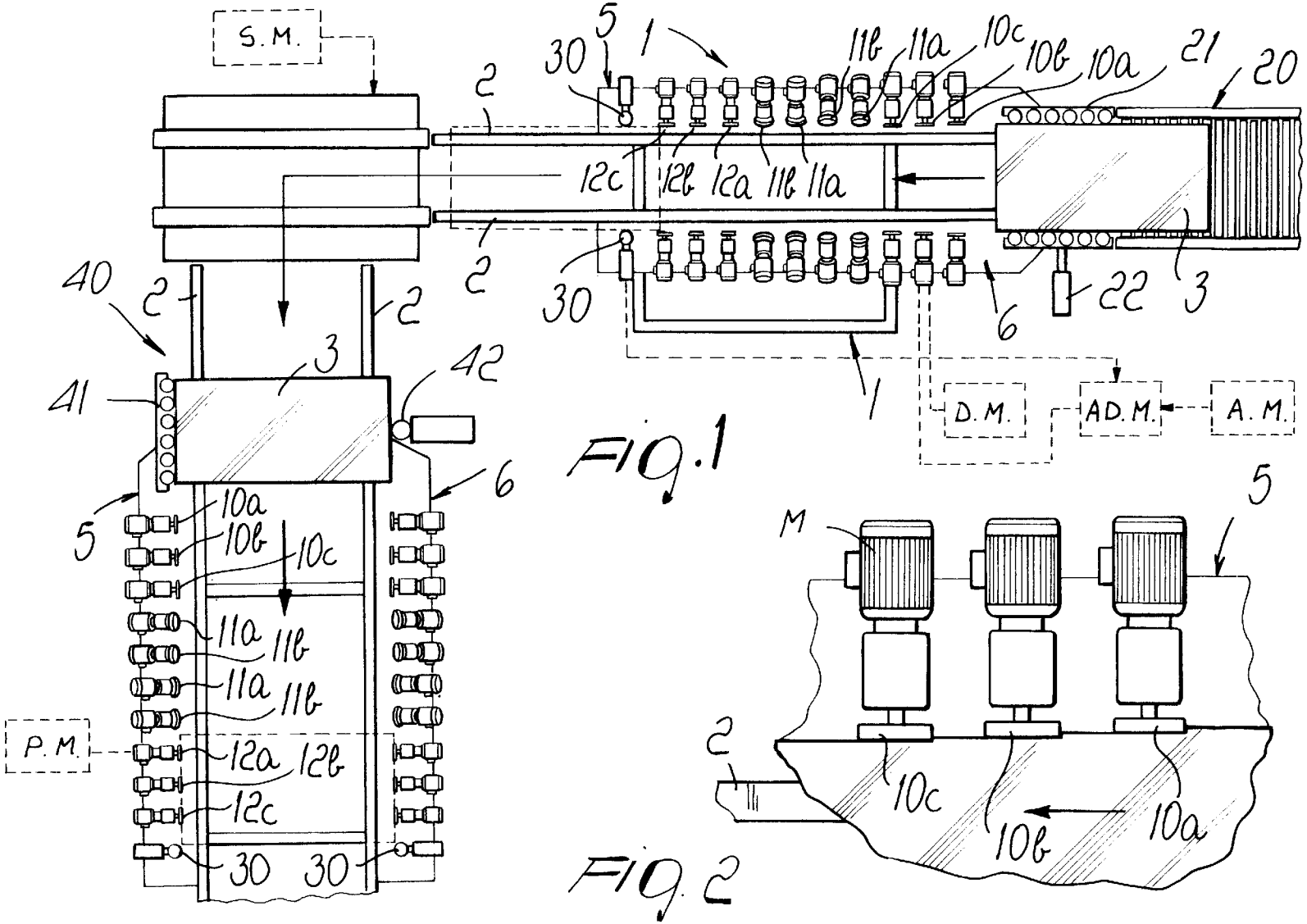
FIG. 1 is a schematic plan view of the machine according to the present invention.
FIG. 2 is a view of a detail of the grinding wheels for removing the edge.

With reference to the above figures, the bilateral automatic machine for machining the edges of plates of glass, stone-like and of other plate shaped materials and the like, comprises a supporting frame generally designated by the reference numeral 1 which is provided with a conveyor for the plates to be machined which is constituted by pairs of belts 2 for retaining and feeding the glass plates 3.

The machine comprises an abutment shoulder 5 and a movable shoulder 6, which support a plurality of abrasive grinding wheels.

In greater detail, grinding wheels, designated by the reference numerals 10*a*, 10*b* and 10*c*, are generally provided for removing the excess material from the glass edge; the number of grinding wheels can of course be changed according to requirements.

Downstream of the removal grinding wheels there are grinding wheels 11*a* for removing the burr on the edge; said grinding wheels are followed by corresponding polishing wheels 11*b*.

Finally, there are polishing wheels 12*a*, 12*b* and 12*c* which perform the final machining of the edge of the glass plate.

At the region upstream of the conveyor 2 it is possible to provide a unit 20 for automatic management of the lateral abutment for glass entry.

For this purpose, the unit 20 has a motorized abutment 21 for arranging said abutment so that if the dimensions of the plate 3 being machined are known, before machining begins it is possible to arrange the abutment so as to equally divide on the two edges the amount of glass that must be removed.

At the unit 20 there is a pusher piston 22 which is designed to push the plate against the motorized abutment 21.

The plate, by entering on the conveyor 2 between the abutment shoulder and the movable shoulder, is subjected first of all to removal of the excess amount of glass.

In order to adjust the machining there is a sensor 30 for detecting the dimensions of the plate at each shoulder.

The sensor 30 detects the position of the machined surface of the glass and considers the displacement from the zero position, i.e., the error; in this manner no actual size measurement is performed, accordingly eliminating any linearity errors of the measurement system, but the displacement from the zero position is measured, with the advantage of using sensors which have a small measurement field and therefore have a high resolution, generally better than 0.01 millimeters.

The sensor 30 drives the last finishing grinding wheel, i.e., the grinding wheel 10*c* in the specific example, which is made to advance, in relation to the fact that grinding wheels can only wear down and therefore increase their distance from the glass, when the sensor in practice indicates an increase in the position of the surface of the glass that exceeds the set tolerance, for example 0.02 millimeters.

Each grinding wheel, except for the first grinding wheel upstream, along the direction of advancement of the plates, is connected to detection means (D.M.) for detecting the absorbed energy. This detection is achieved by measuring the supply voltage, the absorbed current and the phase angle of the motor (M) of each individual grinding wheel-supporting spindle and, by using a table which contains the characteristic points of the torque of the motor. Through linear interpolation between the various values of the table, a signal is obtained which is proportional to the torque required by the spindle. This signal is used by actuation means (A.M.) for actuating the advancement means (AD.M.) for causing the advancement of the grinding wheel that lies directly upstream, i.e., the grinding wheel that lies directly upstream is made to advance when the energy absorbed by the grinding wheel that lies directly downstream increases.

If other types of motorization are used, such as for example an asynchronous motor with inverter, brushless motors and the like, which are more expensive but allow speed adjustment, the torque signal can be obtained from the driver of the motor, either directly or by processing the power and speed signals provided by it.

Advantageously, in order to avoid instabilities, the advancement means (AD.M.) cause the corresponding grinding wheel to advance by a fixed extent, for example 0.01 millimeters, and this advancement cannot be repeated until a certain length, of a number of meters, has been machined.

Substantially, therefore, the preceding grinding wheel is made to advance when its stress decreases and the stress of the next grinding wheel increases; as regards the first grinding wheel, it must be noted that the energy that it absorbs is not usable, since the glass to be machined may not always have the same width, and therefore the first grinding wheel, i.e., the grinding wheel that is located upstream in the advancement direction, is actuated when the stress of the grinding wheel that follows it increases, and so forth to the end.

In practice, the control system is based on the concept of maintaining the initial conditions over time, i.e., the system stores the positional conditions of the sensors and the stress conditions of the spindles when it is activated, and tends to keep them unchanged over time.

Storing means (S.M.) are also provided for storing machining history data for each glass thickness, in order to allow the system to automatically refine and optimize the adjustment control parameters.

The automatic system thus conceived also allows both to inspect the chatter marks of the grinding wheels and to correct them automatically.

When this operation is to be performed, a glass to be machined is inserted and the conveyor stops when the trailing edge of the glass reaches the first grinding wheel 10*a*; then the grinding wheels 10*a*, 10*b* and 10*c* retract by a preset amount, for example 3 millimeters. Then the conveyor restarts and when the leading edge of the glass reaches the sensors 30 it decreases its speed and the sensors detect the positions of the surfaces machined by each band of each individual grinding wheel. The data collected is visualized in order to inspect the chatter marks, and the grinding wheels are made to advance by the amount by which they had been retracted, corrected according to the measured positions and to the required positions.

This cycle is performed in approximately ten minutes, differently from what occurs in a manual machine, which takes half a day and specialized instruments and personnel.

As regards the polishing wheels 12*a*, 12*b* and 12*c*, there are presser means (P.M.) which act independently for each wheel and according to the thickness of the glass to be machined and to the type of wheel used.

In the manual machine it is the operator who, when the thickness to be machined changes, decides whether to modify this pressure or not depending on whether the thickness varies considerably or not.

Normally, the polishing wheels, if there is no glass present, are kept in the working position by means of a suitable brake which is arranged in the pusher cylinder; however, if the thickness of the glass increases, as regards the grinding wheels for the burr or as regards all the polishing wheels, they are moved away from the working position; clearly, when work resumes, the spindles, in positioning themselves, gain speed, with the risk that the impact with the glass may break the glass and spoil the surface of the wheel.

In order to obviate this problem, every polishing wheel is provided with a proportional valve which, when driven, allows to provide a gentle approach to the glass and to modify the working pressure according to tables linked to the thickness and type of glass to be machined; if required by the type of wheel, it is also possible to adjust the pressure according to the measured force or energy absorption.

If the automatic machine also provides for the machining of the other two opposite edges arranged at right angles, it is possible to provide a squaring unit 40 which is also provided with an additional motorized abutment 41 for symmetrical arrangement with respect to the shoulders and there is a movable presser 42 which acts on the plate 3 again in a central position, thus avoiding the need to perform a manual actuation.

It should also be added to the above that the control system that is used can be easily applied also if only one edge is machined, as in straight machines, and even when, instead of a straight flat machining, the edge is beveled; in this case, the only variation is that the glass measurement sensor is mounted on a motorized axis which is applied to the oscillating element, which accordingly follows the inclination of said oscillating element, so that it can be moved into the working position and thus perform its task in the same conditions with detection of the position error of the machined surface, exactly as in the previously described case.

From the above description it is thus evident that the invention achieves the intended aim and objects, and in particular the fact is stressed that a bilateral automatic machine is provided which allows to automate in real time all the adjustments for positioning the grinding wheels, thus achieving great uniformity in machining and optimum and always-repeatable quality.

The invention thus conceived is susceptible of numerous modifications and variations, all of which are within the scope of the inventive concept.

All the details may furthermore be replaced with other technically equivalent elements.

In practice, the materials used, as well as the contingent shapes and dimensions, may be any according to requirements.

The disclosures in Italian Patent Application No. MI99A001382 from which this application claims priority are incorporated herein by reference.

What is claimed is:

1. A bilateral automatic machine for machining edges of plates of glass, stone and of other plate shaped materials, comprising: a supporting frame; a conveyor for advancing along an advancement direction the plates to be machined supported on said frame; an abutment shoulder; a movable shoulder; abrasive grinding wheels being supported in succession on said abutment and movable shoulders, said grinding wheels acting on opposite edges of said plates; motors provided for each individual wheel supporting spindle of said grinding wheels; sensor means, provided for each said abutment and movable shoulders, downstream of the last grinding wheel, in the direction of advancement of said plates for detecting dimensions of the plate being machined; advancement means provided at each said grinding wheel for selective advancement of at least one last grinding wheel of said succession of grinding wheels; detection means for detecting energy absorbed by each said motors, said detection means being provided at each said grinding wheel of said wheel succession except for a first grinding wheel located upstream, along the advancement direction of said plates; and actuation means for actuating said advancement means of one wheel of said grinding wheels that is located immediately upstream as the energy absorbed by a further one of said grinding wheel, located immediately downstream of said one wheel, increases.

2. The bilateral automatic machine of claim 1, further comprising: a lateral abutment for plate entry; a unit located upstream of said conveyor for automatic management of said lateral abutment, said unit having a motorized abutment; a pusher located opposite to said motorized abutment, said motorized abutment being controllable for arranging itself in a position selectable so as to divide an amount of plate width to be removed by said wheels substantially equally on the opposite edges of said plates.

3. The bilateral automatic machine of claim 2, wherein said sensor means is of a type adapted to detect a displacement from a zero position.

4. The bilateral automatic machine of claim 2, wherein said detection means detect measurements of supply voltage, of absorbed current and of a phase angle of said motors for each individual wheel supporting spindle, in order to emit a signal which is proportional to a torque required by the spindle.

5. The bilateral automatic machine of claim 4, wherein said motors of each individual wheel supporting spindle are constituted each by an asynchronous motor with an inverter, said signal that is proportional to the torque being obtained from a driver of each said motor.

6. The bilateral automatic machine of claim 4, wherein said motors of each individual wheel supporting spindle are constituted each by a brushless motor, said signal that is proportional to the torque being obtained from a driver of each said motor.

7. The bilateral automatic machine of claim 4, further comprising storing means for storing data related to machining for different thicknesses of plates, in order to optimize adjustment control parameters.

8. The bilateral automatic machine of claim 7, further comprising polishing wheels, arranged in succession for edge polishing said plates, and pressing means for pressing said polishing wheels, said pressing means acting independently for each said polishing wheel and according to the thickness of the plate being machined.

9. The bilateral automatic machine of claim 8, comprising a proportional valve for each polishing wheel which is driven for gradual approach to the edge of the plate and to modify a working pressure according to the thickness and type of a plate material being machined.

10. The bilateral automatic machine of claim 8, further comprising a squaring unit which is located downstream of the frame for machining a first pair of edges, and is provided with an additional motorized abutment for symmetrical arrangement of edges of the plate to be machined with respect to said abutment shoulder and said movable shoulder.

11. The bilateral automatic machine of claim 10, comprising a presser which is movable in order to act in a central position of the plate being machined.

* * * * *